US005449546A

United States Patent [19]

Kawaguchi

[11] Patent Number: 5,449,546

[45] Date of Patent: Sep. 12, 1995

[54] IMAGE RETRANSFER SHEET

[75] Inventor: Takashi Kawaguchi, Nagoya, Japan

[73] Assignee: Brother Kogyo Kabushiki Kaisha, Nagoya, Japan

[21] Appl. No.: 231,054

[22] Filed: Apr. 22, 1994

[30] Foreign Application Priority Data

Jun. 17, 1993 [JP] Japan ..... 5-145987

[51] Int. Cl.[6] ..... B41M 5/00

[52] U.S. Cl. ..... 428/195; 156/235; 428/206; 428/331; 428/522; 428/523; 428/913; 428/914

[58] Field of Search ..... 428/195, 327, 447, 484, 428/488.1, 488.4, 522, 523, 913, 914, 206, 331, 334, 335, 409; 156/235

[56] References Cited

U.S. PATENT DOCUMENTS 4,870,427 9/1989 Kobayashi et al. ..... 346/1.1
4,973,509 11/1990 Yamane ..... 428/195
5,242,887 9/1993 Usui ..... 503/227

FOREIGN PATENT DOCUMENTS 246298 10/1988 Japan ..... 346/1.1
01152758 4/1991 Japan ..... 428/195

*Primary Examiner*—Pamela R. Schwartz
*Attorney, Agent, or Firm*—Oliff & Berridge

[57] ABSTRACT

An image-retransfer sheet having coated on a base sheet, a layer of a surface treating agent containing a silicone fine powder. The coating layer of the surface treating agent can readily be dried and the coating composition has good storage properties or a long pot life. The image-retransfer sheet exhibits good storage properties.

18 Claims, 1 Drawing Sheet

IMAGE RETRANSFER SHEET

BACKGROUND OF THE INVENTION

1. Field of the Invention

The invention relates to an image-retransfer sheet for dry-processing type image-transferring materials wherein images such as letters, symbols, and figures are transferred with pressure to form such letters, symbols, and figures on an image-receiving material. More particularly, the invention relates to an image-retransfer sheet which is adapted for use in dry-processing type image-transferring materials having images formed by printing and heat-sensitive image transferring by use of heat-sensitive image transferring printing devices such as printers, typewriters, and word processors.

2. Description of Related Art

Hitherto, a technique relating to a base sheet for dry-processing type image-transferring materials which have an image printed by a thermally image-transferring process is set out, for example, in U.S. Pat. No. 4,870,427.

In this technique, the base sheet used is one which comprises a substrate, which has a contact angle with water of at least 95° and is made of a sheet consisting of a film of polyethylene, polypropylene or a fluorine resin, or a paper sheet, a metallic foil or a plastic film such as a polyethylene terephthalate (PET) film, and a layer of a surface treating agent made of a silicone resin and formed on one side of the substrate. By the formation of the layer of the surface treating agent, ink images fixedly secured through thermal transferring are reliably released from the base sheet by pressure-sensitive transfer to ensure retransfer of the images onto an image-receiving material.

In order to thermally print an image onto a base sheet having an angle of contact with water of not smaller than 95° (preferably not smaller than 105°) or a sheet having good release properties (or having poor wettability), it is necessary to liquefy an ink and to reduce the surface tension of the ink to wet the sheet therewith. It is also necessary to increase the adhesion force between the sheet and the ink to an extent greater than the cohesive force of the ink and the adhesion force between the ink and an ink-releasing sheet such as a polyethylene terephthalate (PET) film. To this end, the ink temperature has to be increased when the image is thermally printed, thus requiring high printing energy to be applied to the thermally image-transferring device. This is disadvantageous from the standpoint of thermally image-transferring devices with respect to the durability of their printing head and the load on the power supply.

Images thermally printed on or transferred to a base sheet having poor wettability are readily retransferred by the application of slight pressure owing to a weak adhesion to the base sheet. This will undesirably permit unnecessary portions of the image to be retransferred, thereby causing stains on the image-receiving material. In addition, there arises another problem that when slightly touched during handling, the retransferred image is readily removed.

Moreover, since the base sheet has an extremely small static friction coefficient, the sheet is apt to move and is not readily fixed in position when the thermally transferred ink image is retransferred onto an image-receiving material. This results in the image not being retransferred in position or being distorted. Thus, a complete image cannot be obtained.

In order to prevent undesirable movement of the sheet at the time of retransfer of an image by pressing contact as set out hereinabove, Japanese Laid Open Patent Publication No. 63-246298 proposes a technique of forming a self-adhesive layer on a base sheet separately from a transfer pattern.

However, the partial formation of the self-adhesive layer in position requires a specific manner of formation along with an additional device therefor, thus resulting in great costs. In addition, the self-adhesive layer has to be covered with a release paper before use, which, in turn, requires additional devices and costs. Moreover, with a base sheet which has a releasable surface treating agent layer made of a silicone resin, it is necessary to coat the base sheet with two layers including the layer of a surface treating agent and the self-adhesive layer. Regardless of the coating order of the two layers, there is a fairly large possibility that the later coating is, more or less, affected. More particularly, when a silicone resin is first coated, the subsequent coating of a self-adhesive composition is repelled. On the other hand, when the self-adhesive composition is first coated, the silicone resin is unlikely to coat owing to the stickiness of the self-adhesive. If a release sheet is attached to the self-adhesive coating in order to prevent stickiness, the subsequent coating is not easily performed due to the effect of the thickness of the release sheet. In the event that two coatings can be formed without any problem, the self-adhesive layer is applied only partly. This means that all the circumferential portions of an image are not fixed and the sheet is still likely to move, making it very difficult to form a complete image.

In order to solve the above problems, in U.S. Pat. No. 4,973,509, surface treating agents to which materials having elastic or elongation properties are added have been proposed.

The surface treating agent set out in the U.S. patent comprises a silicone for controlling the wettability of a base sheet and an ethylene-vinyl acetate copolymer or polyethylene for imparting elongation properties to the sheet. The agent exhibits an elongation of at least 100%.

The surface treating agent contains, as the silicone for controlling the wettability of the sheet, either a silicone resin or a silicone oil, or both. For forming the layer of the surface treating agent on a base sheet, a coating composition dissolving a silicone resin therein is applied onto the base sheet and dried. In order that, after removal of the solvent from the coating composition by drying, the surface treating agent layer comprising the silicone resin is left on the base sheet, the molecules of the silicone resin in the composition have to be cured through crosslinkage. This requires an elevated temperature. Accordingly, for complete drying and curing within a short time, the coating composition having the silicone resin dissolved therein has to be coated in reduced amounts. This eventually leads to a lowering of the coating speed with very high production costs.

The curing of the silicone resin requires the addition of a curing catalyst (crosslinking agent) to the coating composition. The curing of the silicone resin gradually proceeds owing to the addition of the catalyst and the curing of the coating composition itself gradually proceeds. This entails a short pot life for the coating composition.

On the other hand, with silicone oils being added, a coating composition containing such a silicone oil is applied onto a base sheet and dried to remove the solvent from the solution, thereby permitting the layer of the surface treating agent layer to be left on the base sheet. Problems in this case are not involved immediately after formation of the coating layer. As time passes, after the formation of the layer, however, the silicone oil in the surface treating agent layer gradually migrates toward the surface of the coating layer. This causes print failure or image-retransfer failure.

SUMMARY OF THE INVENTION

The invention is intended to solve the above problems of the prior art and has for its object the provision of an image-retransfer sheet which has a layer of a surface treating agent readily formed by drying, which makes use of a coating composition having good storage properties or prolonged pot life to form the layer of the agent, so that the storage properties of the image-retransfer sheet are good.

In order to attain the above object, there is provided, according to the invention, an image-retransfer sheet which comprises a base sheet and a layer of a surface treating agent formed on the base sheet, the layer comprising a silicone fine powder.

In the image-retransfer sheet of the invention which has such an arrangement as set out above, the silicone fine powder contained in the surface treating agent layer contributes not only to attaining a similar effect to in the case using either or both of a silicone resin and a silicone oil, but also to solving the problem of curing a silicone at the time of coating of the surface treating agent. Moreover, the drying of the layer is easy and good storage properties of the coating composition used to form the layer of the surface treating agent are ensured. In addition, the silicone does not migrate in the layer of the surface treating agent and good storage properties for the image-retransfer sheet are attained.

BRIEF DESCRIPTION OF THE DRAWING

A preferred embodiment of the invention will be described in detail with reference to the accompanying drawing, wherein.

DETAILED DESCRIPTION OF THE PREFERRED EMBODIMENT

Figure 1:
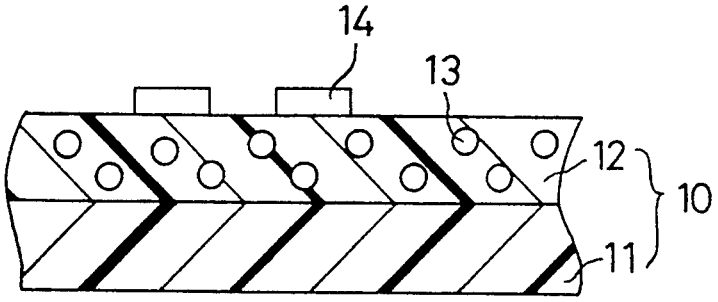
FIG. 1 is a schematic sectional view of an image-retransfer sheet.

The preferred embodiment according to the invention will be described hereunder with reference to the accompanying drawing.

As shown in FIG. 1, an image-retransfer sheet 10 in an embodiment according to the invention comprises a substrate 11 and a layer 12 of a surface treating agent containing a silicone fine powder 13 wherein the layer 12 is formed on one surface of the substrate 11. A thermally printed or transferred image 14 is formed on the layer 12 by thermal transfer.

The substrate 11 preferably has a thickness of from 25 to 200 μm, more preferably from 50 to 150 μm. If the substrate 11 has a thickness smaller than 25 μm, there is the possibility that the substrate does not have a mechanical strength sufficient to stand up to production and handling and when a pressure is applied at the time of image retransfer, the substrate is undesirably elongated, thereby causing the resultant retransferred image to be distorted. Preferably, the substrate should be a film which has an elongation of not more than 200%. The reason why the thickness is preferably not larger than 200 μm is that when the thickness exceeds 200 μm, flexibility is so poor that the applied pressure at the time of image retransfer is likely to be inadequate with a great possibility that a failure in the image retransfer will take place.

In order to ensure precise retransfer of the ink image 14 on an image-receiving material in position, the substrate 11 should preferably be transparent or semi-transparent. Especially, it is more preferred to use a semi-transparent sheet because the complete retransfer of the thermally transferred ink image 14 is easy to confirm.

Examples of the substrates 11 having the desired characteristic properties as set out hereinabove include plastic films, paper sheets, and metallic foils. Examples of the plastic films include films of polyethylene, polypropylene, fluorine-containing resins such as ethylene-tetrafluoroethylene copolymers and tetrafluoroethylene-hexafluoroethylene copolymers, polyethylene terephthalate (PET), polyamides, polyimides, polyvinyl chloride, polycarbonates, polysulfones, ethylene-vinyl acetate copolymers, acrylonitrile-butadiene-styrene copolymers, and ionomers.

The layer 12 of the surface treating agent formed on one side of the substrate 11 should have an elongation of not less than 100% and should contain a silicone fine powder 13.

The use of the surface treating agent exhibiting an elongation of not less than 100% allows the layer of the agent alone to be elongated upon application of pressure at the time of the image retransfer. Accordingly, the adhesion force between the surface treating agent and the thermally transferred image 14 becomes weak, so that even if a surface treating agent which has good wettability and great adhesion force is used, good retransferability is attained. On the contrary, when a surface treating agent having an elongation less than 100% is used, it is not possible to weaken the adhesion force between the surface treating agent and the thermally transferred image 14. Thus, a failure in image retransfer is liable to occur.

When the layer 12 of the surface treating agent is formed on the substrate 11, the silicone fine powder 13 is uniformly dispersed in the coating composition used to form the layer 12. When the solvent is dried from the coating composition, the layer 12 is formed on the substrate 11 with the silicone fine powder remaining uniformly dispersed in the surface treating agent. In comparison with the case using silicone resins, the use of the silicone fine powder is advantageous in that it is not necessary to cure silicone fine powders. Thus, any problem of curing silicones at the time when the coating of a surface treating agent is dried is not involved in the invention, ensuring easy drying of the coating film. In addition, the coating composition for the layer has good storage properties. The comparison with silicone oils reveals that the silicone fine powder does not move or migrate in the layer of the surface treating agent having good high temperature storage properties. The silicone fine powder 13 in the surface treating agent layer 12 is in the range of 0.1 to 20 parts by weight, preferably from 0.5 to 10 parts by weight.

Examples of the resin used as a major component of the surface treating agent include polyethylene, ethylene-vinyl acetate copolymers, ethylene-ethyl acrylate copolymers, ethylene-acrylic copolymers, ionomers, and ethylene-methacrylic copolymers.

The layer 12 of surface treating agent should preferably have a static friction coefficient of not smaller than 0.25, more preferably not smaller than 0.3. When the static friction coefficient is smaller than 0.25, there is a high possibility that when the thermally transferred ink image 14 is retransferred from the base sheet to an image-receiving material, the base sheet will move and its position undesirably shifted. This makes it difficult to fix the sheet and form a complete retransferred image on the image-receiving sheet.

The surface treating agent layer 12 should preferably have an angle of contact with water of from 80° to 120°, more preferably from 80° to 110°. This is because when the contact angle is smaller than 80°, the adhesion force between the thermally transferred ink image 14 and the image-retransfer sheet 10 becomes so high that a failure in image retransfer is apt to occur. On the contrary, when the contact angle exceeds 120°, good wettability is not obtained, resulting in a tendency toward a thermal transfer failure of the image. When the contact angle is in the range of from 80° to 120°, an optimum adhesion force between the thermally transferred ink image 14 and the retransfer sheet 10 is ensured. Accordingly, good thermal transferability and retransferability are attained without involving retransfer of unnecessary portions of an image by application of a slight pressure exerted thereon. In addition, when rubbed, the transferred or retransferred image is unlikely to be separated, thus being easy to handle.

In general, when a large-sized image is transferred by use of a thermal transfer device of the serial type which has a small-sized printing head, it is necessary to form an image through several cycles of printing operations and transfer the resulting image portions by superposition. This presents the problem that a once transferred image portion may be at least partially scraped off by means of the printing head in a subsequent cycle of transfer, with a resultant difficulty in obtaining a complete image. To avoid this, an image is divided into portions and the divided portions are transferred separately from one another so as to follow one another. By this method, the respective image portions are prevented from being scraped off by the printing head as they are printed sequentially. When retransferred, the divided image portions are superposed one by one to complete a retransferred image. When the layer of a surface treating agent is arranged as in the invention, the adhesion force becomes so great that it is possible to carry out thermal transfer in a state where a large-sized image is in a joined condition. Since the retransfer sheet 10 has good wettability and great adhesion force, a low thermal transfer energy is sufficient to form a thermally transferred image of high quality.

The ink ribbon used to thermally transfer a desired ink image 14 on the retransfer sheet 10 may be one of those which are ordinarily used in heat-sensitive image-transferring printing devices such as printers, typewriters, and word processors. Such ink ribbons may be those having a coating of an ink mainly composed of wax. Especially, it is preferred to use an ink ribbon having a double-layer structure which includes a transferability-controlling layer and an ink layer in order to improve thermal transferability and pressure-sensitive retransferability. The transferability-controlling layer is formed on the ink layer as a top coating and is higher in heat-sensitive adhesion, hardness, viscosity and cohesive force than the ink layer. By this, thermal transferability to a retransfer sheet which is poor in wettability becomes significantly improved, thus realizing pressure-sensitive retransfer as a whole. In addition, the ink layer is imparted with good pressure-sensitive adhesiveness, thus leading to a better pressure-sensitive adhesiveness in a total system.

EXAMPLE 1

A coating composition of the following formulation used to form a layer of a surface treating agent was coated onto a 50 μm thick polyethylene terephthalate film in a thickness of 4 μm and dried to obtain a retransfer sheet. The retransfer sheet had a smooth coating surface having an angle of contact with water of 103° to 106° and a static friction coefficient of approximately 0.30. The elongation of the surface treating agent was about 600%.

The drying conditions were 90° C. for 60 seconds which involved no problems.

| Coating Composition for Layer of Surface Treating Agent: | Parts by weight |
|---|---|
| Ethylene-vinyl acetate copolymer ["EVAFLEX 640" of DUPONT-MITSUI POLYCHEMICALS CO., LTD.] | 100 |
| Silicone fine powder ["TOREFIL R-902" of TORAY DOW CORNING SILICONE CO., LTD.] | 3 |
| Toluene | 897 |

The resultant retransfer sheet was thermally transferred thereon with an ink pattern using an adjusted heat-sensitive transfer tape writer, thereby obtaining a dry-processing image-transferring material having a transfer image of intended good quality.

The image-transferring material was used and subjected to pressure-sensitive retransfer onto various image-receiving sheets, such as paper or plastics, thereby obtaining a retransfer image of good quality. During the course of the retransfer operation, the sheet was moved only slightly and the retransfer operation could be performed in a fixed condition, with the advantage that a retransfer image of good quality was readily obtained.

When the coating composition was allowed to stand over 48 hours and then coated, no problem in coating was found. Using an image-retransfer sheet obtained after drying, a printing and retransferring test was effected, thereby obtaining printed images of good quality without any problem.

Subsequently, the retransfer sheet was kept at 70° C. for 8 hours and then subjected to a printing and retransferring test in the same manner as set out above. As a result, there was obtained a printed image of good quality with no problems. It was found that the retransferability was good.

COMPARATIVE EXAMPLE 1

A coating composition of the following formulation was coated onto a 50 μm thick polyethylene terephthalate and dried, thereby obtaining image-retransfer sheets having a smooth surface which had an angle of contact with water of 103° and a static friction coefficient of approximately 0.37. The elongation of the surface treating agent was 650%.

The drying conditions were 90° C. for 60 seconds involved no problems.

| Coating Composition for Layer of Surface Treating Agent: | Parts by weight |
|---|---|
| Ethylene-vinyl acetate copolymer ["EVAFLEX 640" of DUPONT-MITSUI POLYCHEMICALS CO., LTD.] | 100 |
| Silicone oil ["KP-358" of Shin-Etsu Chemical Co., Ltd.] | 3 |
| Toluene | 897 |

The resultant retransfer sheet was thermally transferred thereon with an ink pattern using an adjusted heat-sensitive transfer tape writer in the same manner as in Example 1, thereby obtaining a dry-processing image-transferring material having a transfer image of intended good quality.

Sheets of the image-transferring material were used and subjected to pressure-sensitive retransfer onto various image-receiving sheets, such as paper or plastics, thereby obtaining retransfer images of good quality. During the course of the retransfer operations, the sheets moved only slightly and the retransfer operations could be performed in a fixed condition, with the advantage that retransfer images of good quality were readily obtained.

Thereafter, the coating composition was allowed to stand over 48 hours and coated, no coating problem was encountered. Using image-retransfer sheets obtained after drying, printing and retransferring tests were effected, thereby obtaining printed images of good quality without any problem.

However, when the retransfer sheets were kept at 70° C. for 8 hours and then subjected to a printing and retransferring tests, the resultant printed images were not of good quality. This was considered to have resulted from the migration of the silicone oil toward the surface of the layer of the surface treating agent.

COMPARATIVE EXAMPLE 2

A coating composition of the following formulation was coated onto a 50 μm thick polyethylene terephthalate sheet and dried, thereby obtaining image-retransfer sheets having a smooth surface which had an angle of contact with water of 108° to 110° and a static friction coefficient of approximately 0.36. The elongation of the surface treating agent was 650%.

The drying conditions required a drying time of approximately 180 seconds at a drying temperature of 90° C. Thus, a substantial quantity of heat was necessary.

| Coating Composition for Layer of Surface Treating Agent: | Parts by weight |
|---|---|
| Ethylene-vinyl acetate copolymer ["EVAFLEX 640" of DUPONT-MITSUI POLYCHEMICALS CO., LTD.] | 100 |
| Silicone resin ["KS-841" of Shin-Etsu Chemical Co., Ltd.] | 0.97 |
| Curing agent ["PL-8" of Shin-Etsu Chemical Co., Ltd.] | 0.03 |
| Toluene | 899 |

The resultant retransfer sheets were thermally transferred thereon with an ink pattern using an adjusted heat-sensitive transfer tape writer in the same manner as in Example 1, thereby obtaining dry-processing image-transferring materials having a transfer image of intended good quality.

The image-transferring materials were used and subjected to pressure-sensitive retransfer onto image-receiving sheets, such as paper or plastics, thereby obtaining retransfer images of good quality. During the course of the retransfer operations, the sheets were moved only slightly and the retransfer operations could be performed in a fixed condition, with the advantage that retransfer images of good quality was readily obtained.

Thereafter, retransfer sheets were kept at 70° C. for 8 hours and then subjected to a printing and retransferring tests in the same manner. As a result, printed images of good quality could be obtained without any problem, with an advantage of good retransferability.

However, when kept over 48 hours, the coating composition was cured with its viscosity being considerably increased, making it impossible to coat.

What is claimed is:

1. An image-retransfer sheet for dry-processing type image-transferring materials, comprising:

a substrate;

a continuous layer of a surface treating agent coated on one surface of said substrate, said surface treating agent having an elongation of at least 100% and containing a silicone fine powder; and a discontinuous transferable image on a surface of the surface treating agent, said transferable image for transfer to a further object by the application of pressure to a back side of said substrate.

2. The image-retransfer sheet according to claim 1, wherein said layer of a surface treating agent contains an ethylene vinyl acetate copolymer.

3. The image-retransfer sheet according to claim 1, wherein said layer of a surface treating agent contains polyethylene.

4. The image-retransfer sheet according to claim 1, wherein said layer of a surface treating agent has a static friction coefficient of at least 0.25 and a contact angle with water of from 80° to 120°.

5. The image-retransfer sheet according to claim 1, wherein said transferable image is placed on said surface of said layer of a surface-treating agent by a heat-sensitive transferring method.

6. The image-retransfer sheet according to claim 1, wherein said silicone fine powder is contained in the range of 0.1 to 20 parts by weight.

7. The image-retransfer sheet according to claim 6, wherein said silicone fine powder is contained in the range of 0.5 to 10 parts by weight.

8. An image-retransfer sheet comprising:

a substrate;

a surface treating agent coated on one surface of said substrate, said surface treating agent having an elongation of at least 100% and containing a silicone fine powder uniformly dispersed therein; and a transferable image formed on said surface treating agent, said transferable image being transferable to a further object by the application of pressure to a back side of said substrate.

9. The image-retransfer sheet as claimed in claim 8, wherein said substrate has a thickness in the range of 25 to 200 μm.

10. The image-retransfer sheet as claimed in claim 9, wherein said substrate's thickness is in the range of 50 to 150 μm.

11. The image-retransfer sheet as claimed in claim 8, wherein said substrate has an elongation factor of not more than 200%.

12. The image-retransfer sheet as claimed in claim 8, wherein said substrate is one of transparent and semi-transparent.

13. The image-retransfer sheet as claimed in claim 8, wherein said silicone fine powder constitutes 0.1 to 20 parts by weight of said surface treating agent.

14. The image-retransfer sheet as claimed in claim 13, wherein said silicone fine powder is 0.5 to 10 parts by weight of said surface treating agent.

15. The image-retransfer sheet as claimed in claim 8, wherein said surface treating agent has a static friction coefficient greater than 0.25.

16. The image-retransfer sheet as claimed in claim 15, wherein said static friction coefficient is greater than 0.3.

17. The image-retransfer sheet as claimed in claim 8, wherein said surface treating agent has an angle of contact with water in a range of 80° to 120°.

18. The image-retransfer sheet as claimed in claim 17, wherein said angle of contact with water is in the range of 80° to 110°.

* * * * *